US009179766B2

(12) United States Patent
Lai et al.

(10) Patent No.: US 9,179,766 B2
(45) Date of Patent: Nov. 10, 2015

(54) FOLDING TABLE

(71) Applicants: Jennifer Ying Lai, Rancho Cucamonga, CA (US); Jiaxun Cao, Rancho Cucamonga, CA (US)

(72) Inventors: Jennifer Ying Lai, Rancho Cucamonga, CA (US); Jiaxun Cao, Rancho Cucamonga, CA (US)

( * ) Notice: Subject to any disclaimer, the term of this patent is extended or adjusted under 35 U.S.C. 154(b) by 0 days.

(21) Appl. No.: 14/598,600

(22) Filed: Jan. 16, 2015

(65) Prior Publication Data

US 2015/0257527 A1 Sep. 17, 2015

Related U.S. Application Data

(60) Provisional application No. 61/979,202, filed on Apr. 14, 2014, provisional application No. 61/951,206, filed on Mar. 11, 2014.

(51) Int. Cl.

| | |
|---|---|
| ***A47B 3/00*** | (2006.01) |
| ***A47B 3/091*** | (2006.01) |
| ***A47B 3/08*** | (2006.01) |

(52) U.S. Cl.

CPC ..... *A47B 3/0912* (2013.01); *A47B 3/0818* (2013.01)

(58) Field of Classification Search

CPC ..... A47B 3/00; A47B 3/02; A47B 3/08; A47B 3/0912; A47B 3/13; A47B 2003/0821

USPC ..... 108/115, 128, 48

See application file for complete search history.

(56) References Cited

U.S. PATENT DOCUMENTS

| | | | | |
|---|---|---|---|---|
| 1,256,197 | A * | 2/1918 | Bettinardi | 108/115 |
| 1,420,206 | A * | 6/1922 | Milam | 108/48 |
| 2,299,910 | A * | 10/1942 | Linderme | 108/115 |
| 2,784,004 | A * | 3/1957 | Hamrick, Jr. | 108/48 |
| 3,322,077 | A * | 5/1967 | Kovacik | 108/115 |
| 5,592,887 | A * | 1/1997 | Teng | 108/163 |
| 5,775,655 | A * | 7/1998 | Schmeets | 108/115 |
| 5,819,670 | A * | 10/1998 | O'Connor et al. | 108/48 |
| 6,192,808 | B1 * | 2/2001 | Bue | 108/115 |
| 6,698,364 | B2 * | 3/2004 | Welch et al. | 108/115 |
| 6,786,162 | B1 * | 9/2004 | Volkmer et al. | 108/115 |
| 6,811,233 | B1 * | 11/2004 | Packer | 108/176 |
| 7,647,872 | B2 * | 1/2010 | Pitchford | 108/48 |
| 8,365,676 | B1 * | 2/2013 | McAuliff | 108/48 |
| 2003/0024444 | A1 * | 2/2003 | Welch et al. | 108/115 |
| 2003/0056699 | A1 * | 3/2003 | Malizia | 108/115 |
| 2005/0274300 | A1 * | 12/2005 | Chen | 108/115 |
| 2006/0185566 | A1 * | 8/2006 | Mangano et al. | 108/115 |
| 2010/0229767 | A1 * | 9/2010 | Chiu | 108/115 |

* cited by examiner

*Primary Examiner* — Jose V Chen
(74) *Attorney, Agent, or Firm* — Clement Cheng

(57) ABSTRACT

A folding table has a plank, a substantially vertical support member, and a first leg that can have a first leg first section and a first leg second section. The first leg first section slides relative to the first leg second section when the table is folded between a deployed position and a stowed position. The first leg has an adjustable length. The first leg has a first leg upper joint allowing the first leg to fold between a first leg deployed position and a vertical stowed position. A second leg has a second leg first section and a second leg second section. The second leg first section is jointed to the second leg second section. The second leg has a second leg upper joint connected to the plank or the plank frame.

14 Claims, 8 Drawing Sheets

FOLDING TABLE

The present invention claims priority from U.S. provisional application 61/979,202 filed Apr. 14, 2014 entitled Folding Table and from U.S. provisional application 61/951,206 filed Mar. 11, 2014 entitled Folding Table, by same inventors Jennifer Ying Lai and Jiaxun Cao, the disclosures of which are incorporated herein by reference.

FIELD OF THE INVENTION

The present invention is in the field of folding tables.

DISCUSSION OF RELATED ART

A variety of folding tables had been made in the prior art. Folding tables have generally had a pair of foldable legs. Unfortunately, many times, the folding legs require a substantial amount of strength to fold and unfold. Sometimes, more than one person is needed for folding the table.

SUMMARY OF THE INVENTION

A folding table has a plank that can be supported by a plank frame and a substantially vertical support member. The plank is directly or indirectly rotationally connected to the substantially vertical support member. The plank can be connected via or to the first leg first section. The plank rotates between a substantially horizontal plank deployed position and a substantially vertical plank stowed position. The first leg has a first leg upper joint allowing the first leg to fold between a first leg deployed position and a first leg stowed position where the first leg is substantially vertical. The first leg is probably single section.

A second leg has a second leg first section and a second leg second section. The second leg first section is jointed to the second leg second section. The second leg first section is a second leg upper section, and the second leg second section is a second leg lower section. The second leg upper section is biased into a straight collinear position relative to the second leg lower section when the second leg is in a second leg deployed position. The second leg upper section rotates relative to the second leg lower section when the second leg moves to a second leg stowed position. The second leg upper joint supports the plank or plank frame which supports the plank directly or indirectly. The substantially horizontal plank deployed position mechanically coincides with the second leg stowed position and the first leg stowed position. The substantially vertical plank stowed position mechanically coincides with the first leg deployed position and the second leg deployed position.

A folding table has a plank, a substantially vertical support member, a first leg having a first leg first section and a first leg second section. The first leg first section slides relative to the first leg second section when the table is folded between a deployed position and a stowed position. The first leg has an adjustable length. The first leg has a first leg upper joint allowing the first leg to fold between a first leg deployed position and a vertical stowed position. A second leg has a second leg first section and a second leg second section. The second leg first section is jointed to the second leg second section. The second leg has a second leg upper joint connected to the plank or the plank frame. The second leg first section and the second leg second section nest with each other in the second leg stowed position.

The folding table optionally includes a third leg pivotally connected to the substantially vertical support member at a third leg swivel joint. A lower platform can be supported by the first leg. A lower platform support can support the lower platform. The lower platform support can be pivotally connected to the first leg. The lower platform support is pivotally connected to the lower platform. The plank may further include a plank frame. The plank frame can support the plank.

Optionally, the first leg can be formed as a first leg upper section hinged to the first leg lower section at a first leg upper section lower joint. The first leg upper section can have a first leg upper section lower member and a first leg upper section upper member hinged at a first leg upper section upper joint. The first leg upper section lower joint may also further include a joint extension and a joint extension swivel connecting to the first leg upper section lower member.

Optionally, a third leg pivotally is connected to the substantially vertical support member at a third leg swivel joint. The third leg is connected to the substantially vertical support member at a third leg swivel joint, and the third leg is swivel connected to the first leg at a first leg lower joint. The first leg is connected to the second leg upper section at an intermediate first leg upper joint. The second leg lower section has a locking member fitted to allow a sliding motion within a locking member slot formed on the second leg lower section. The locking member is biased by a locking member spring. The locking member engages a second leg locking notch formed on the second leg upper section lower end. Also, the locking member can engage a second leg locking notch formed on the second leg lower section upper end.

Optionally, a second plank is mounted to the substantially vertical support member at a second plank main swivel. The second plank is supported by a second plank support. The second plank is swivel connected to the second plank support at a second plank outside swivel. The second plank side rails each may have a second plank side rail slot. The second plank side rail slot receives a second plank rail support, and the second plank rail support is pivotally attached to the second plank side rails at a second plank outside swivel. The second plank rail support is also pivotally attached to the second plank rail support swivel and either the first leg upper joint or the second leg lower section.

Figure 1:
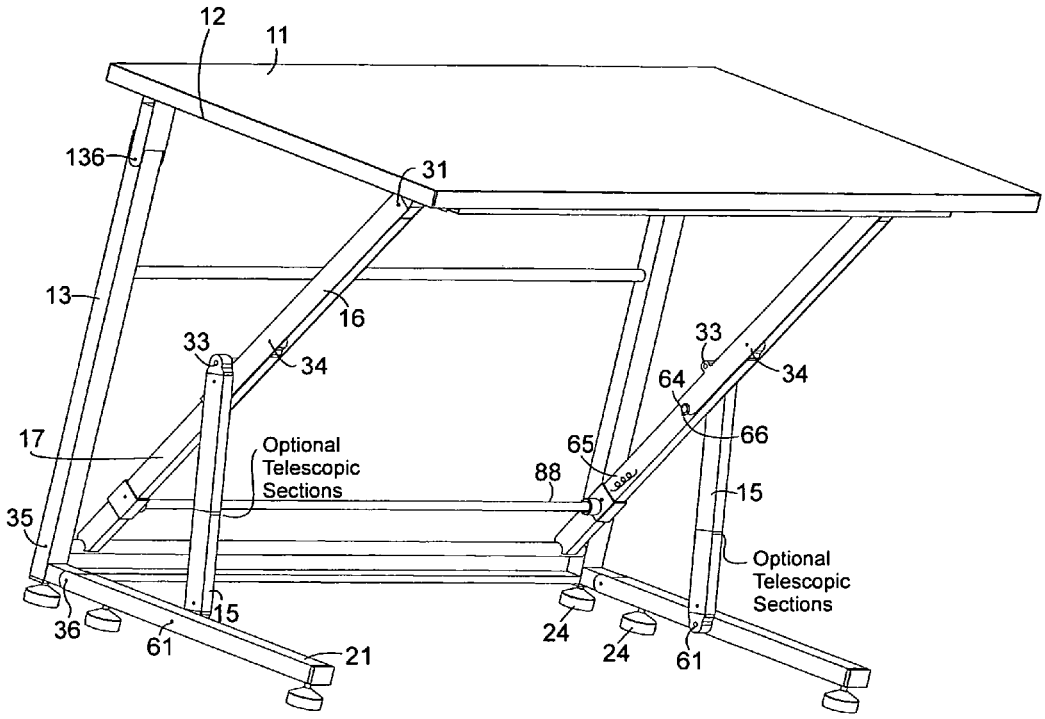
FIG. 1 is a perspective view of the folding table in open position.
Figure 2:
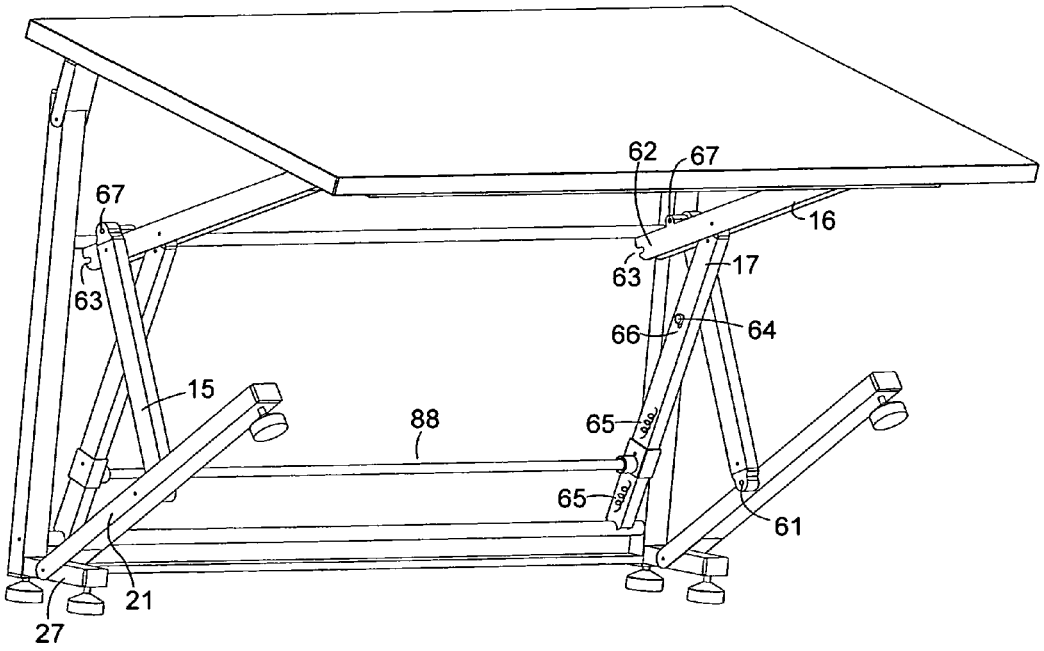
FIG. 2 is a partially open view showing folding of the table in intermediate position.
Figure 3:
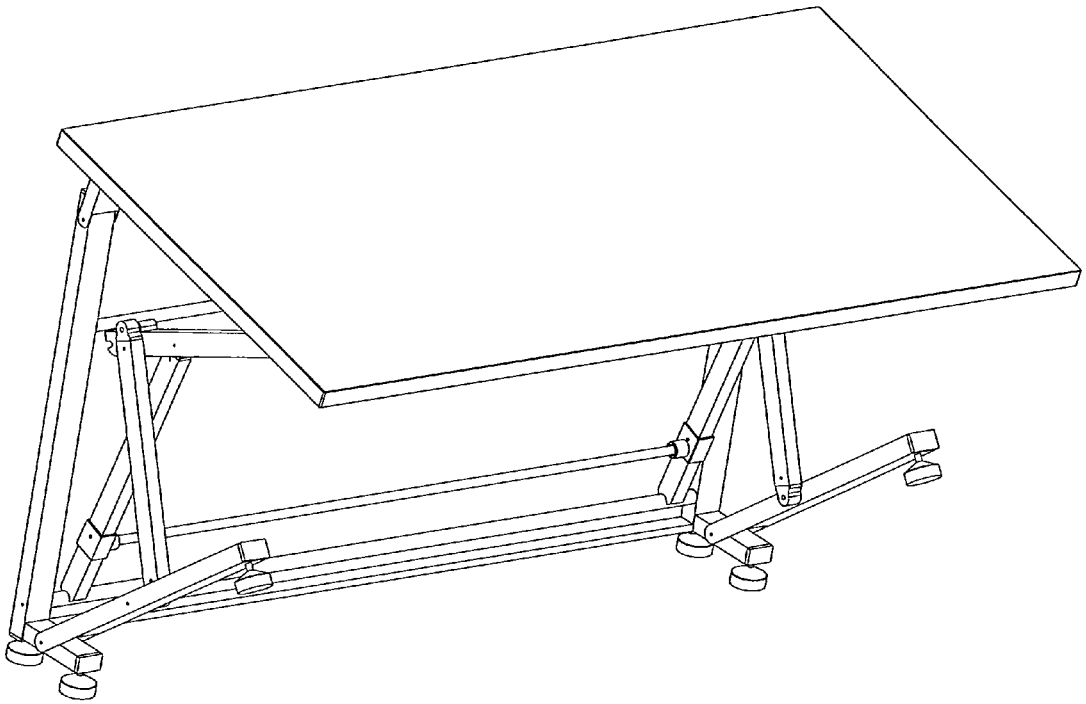
FIG. 3 is a partially open view showing folding of the table in intermediate almost closed position.
Figure 4:
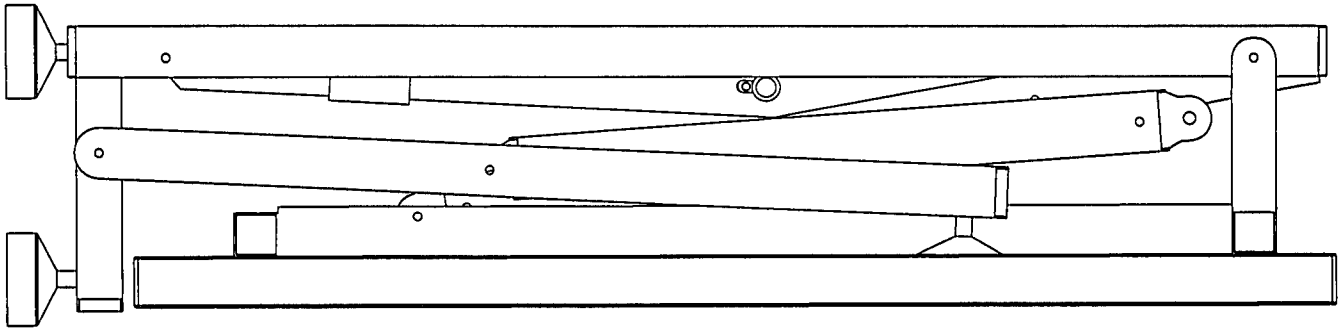
FIG. 4 is a side view of the folding table in closed position.
Figure 5:
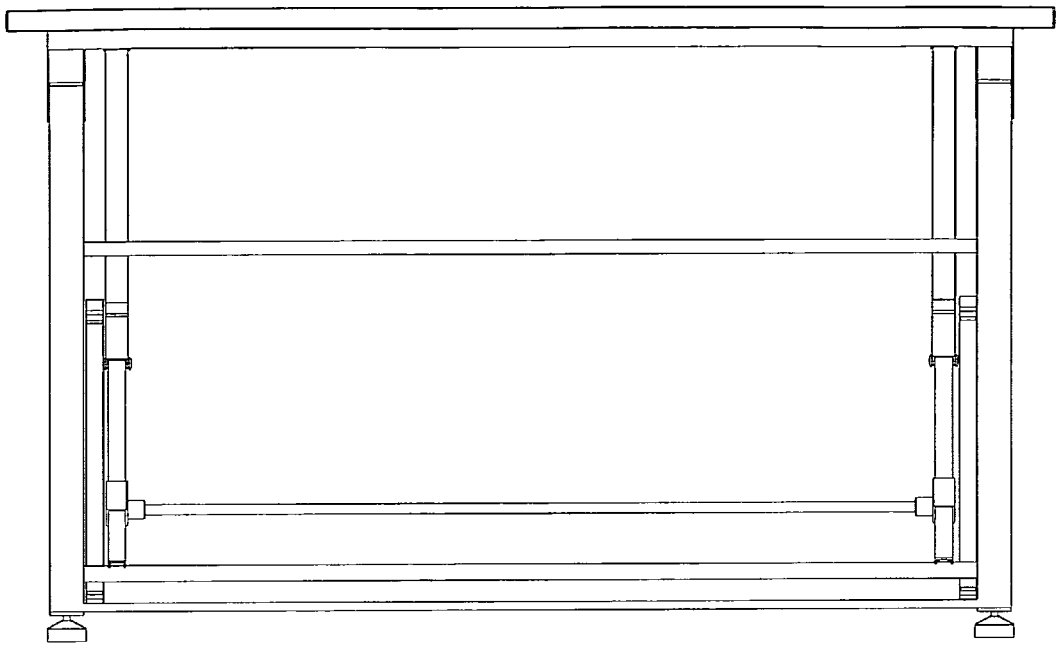
FIG. 5 is a front view of the folding table in open position.
Figure 6:
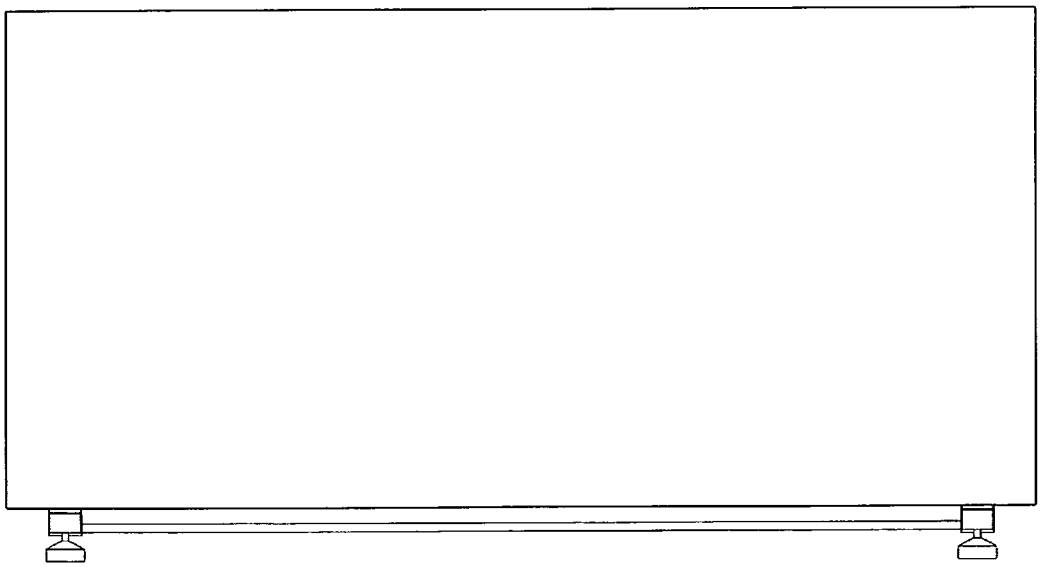
FIG. 6 is a front view of the folding table in closed position.
Figure 7:
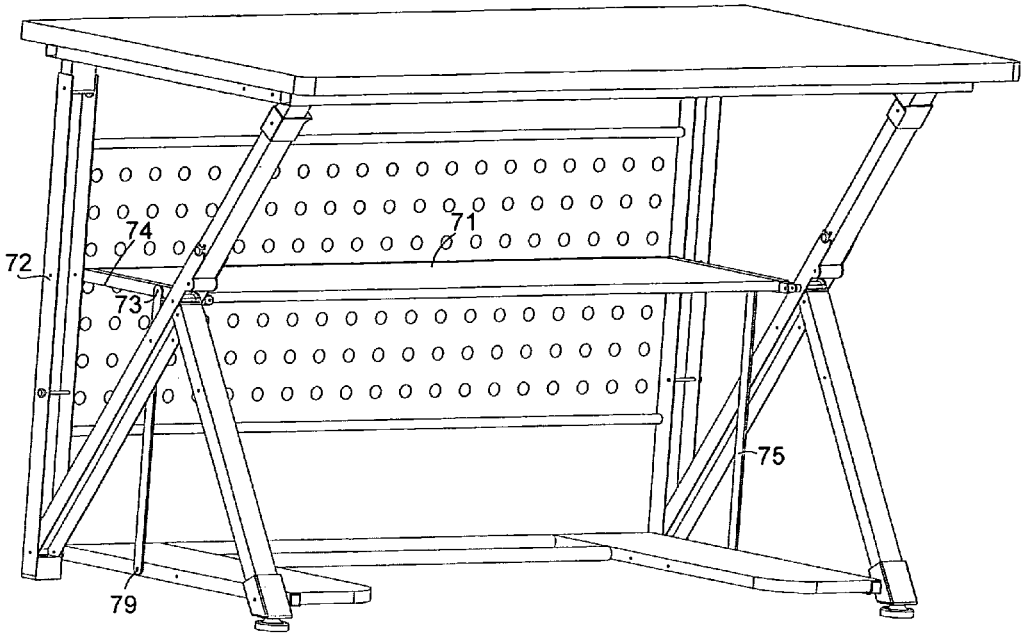
FIG. 7 is a perspective view of the folding table in open position with the second plank shown.
Figure 8:
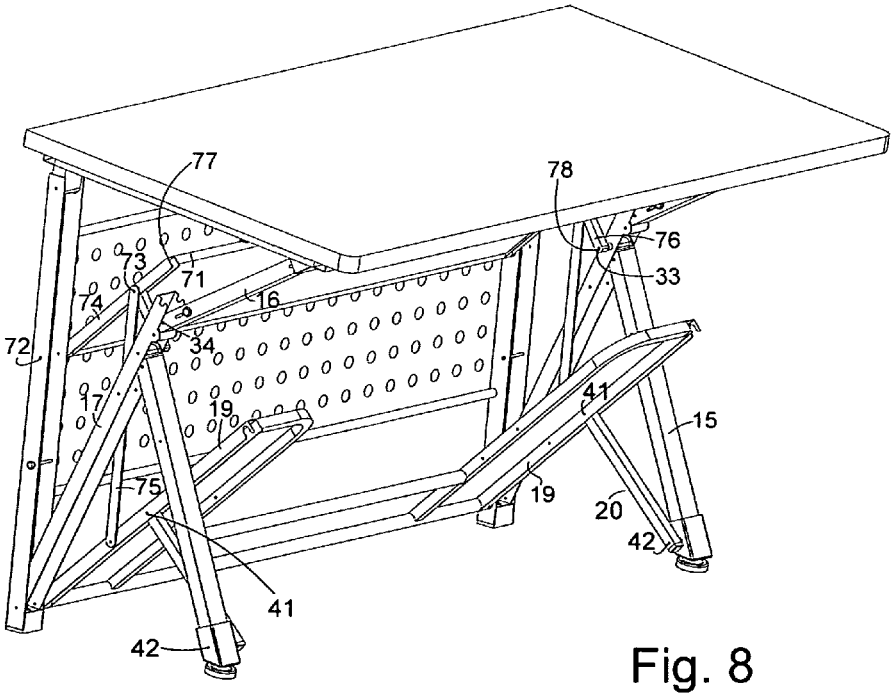
FIG. 8 is a partially open view showing folding of the table in FIG. 7.
Figure 9:
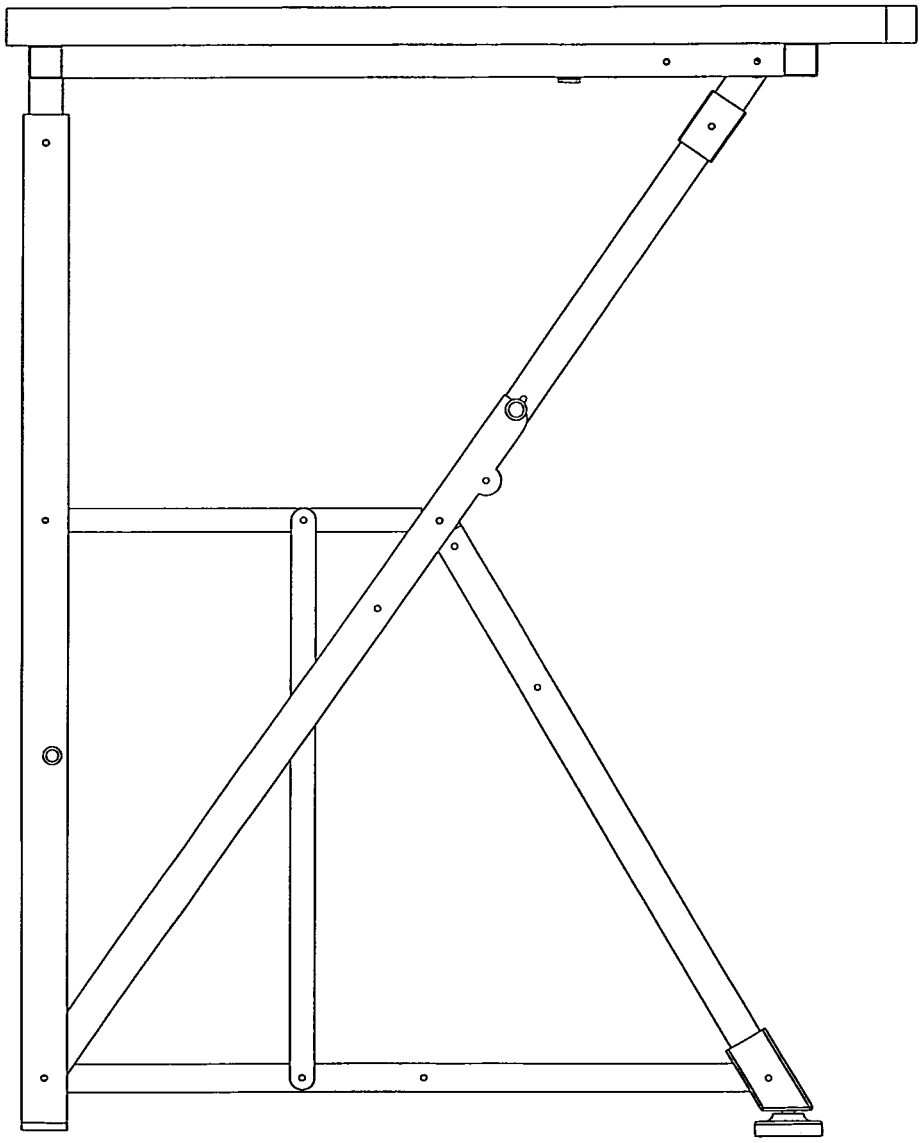
FIG. 9 is a side view of the table in FIG. 7 in open position.
Figure 10:
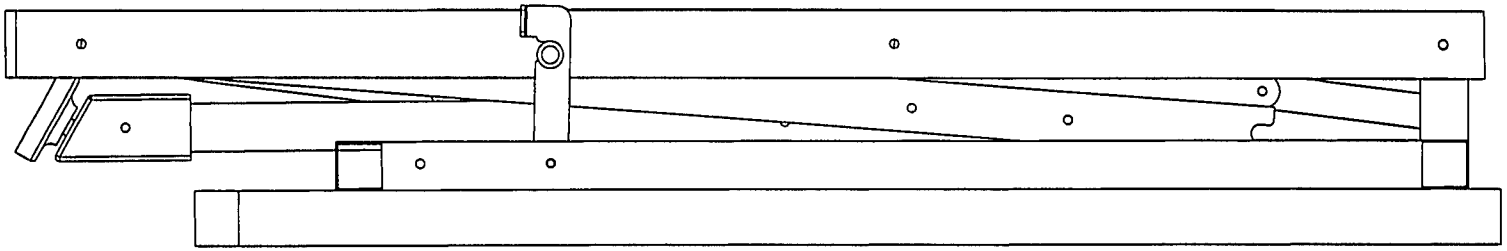
FIG. 10 is a side view of the table in FIG. 7 in closed position.

The following call out list of elements can be a useful guide in referencing the element numbers of the drawings.

11 Plank
12 Plank Frame
13 Substantially vertical support member
15 First Leg
16 Second Leg Upper Section
17 Second Leg Lower Section

19 Lower Platform
20 Lower Platform Support
21 Third Leg
24 Bottom Foot
27 Third Leg Extension
31 Second Leg Upper Joint
33 First Leg Upper Joint
34 Second Leg Breaking Joint
35 Second Leg Lower Joint
36 Third Leg Swivel Joint
136 Plank Swivel Joint
41 Lower Platform Support Inside Joint
42 Lower Platform Support Outside Joint
61 First Leg Lower Joint
62 Second Leg Upper Section Lower End
63 Second Leg Locking Notch
64 Locking Member
65 Locking Member Spring
66 Locking Member Slot
67 Intermediate First Leg Upper Joint
71 Second Plank
72 Second Plank Main Swivel
73 Second Plank Outside Swivel
74 Second Plank Side Rails
75 Second Plank Support
76 Second Plank Rail Support
77 Second Plank Side Rail Slot
78 Second Plank Rail Support Swivel
79 Second Plank Support Lower Swivel Connection
88 Foot Bar

DETAILED DISCUSSION OF THE PREFERRED EMBODIMENT

The table frame generally has a plank 11 supported by a plank frame 12. The plank can be made of metal, fiberboard, or plastic such as blowmold. When the plank is made of plastic or fiberboard, a metal frame can reinforce the surfaces, edges or periphery of the plank. Although the plank is preferably substantially rigid, the plank can be made as a flexible member. The plank can be made as a reflective, transparent or opaque member. The plank can be made in any shape such as a square, rectangle or curved shape such as an ironing board, or a coffee table. The best mode of the plank is as a desk such as a student desk. The plank for plank frame can be hinged to the substantially vertical support member.

The plank folds from a 0° to a 90° angle relative to a substantially vertical support member 13 at the plank swivel joint 136. The plank can be directly or indirectly hinged to the substantially vertical support member. A user can grasp the plank such as by an edge of the plank. The plank may have a handle for grasping. The handle can be hardware handle, or an opening in the plank to allow the user to grip the edge of the plank. The user can be assisted by one or more shock or spring mechanisms. The plank folds downward into a stowed position from a deployed position.

Besides the substantially vertical support member 13, there is also a first pair of legs 15 and second pair of legs and a third supplemental leg pair. The first leg 15 is connected to the second leg. The first leg 15 can be connected to the second leg upper section, or the second leg lower section. The substantially vertical support member, first pair of legs, the second pair of legs, and the third pair of legs can each optionally have a reinforcing crossmember connecting the pair of left and right distal extremities to make a rigid connection.

The second pair of legs has a second leg upper section 16 and a second leg lower section 17. The second pair of legs can be placed outside or distal of the first pair of legs, or alternatively the second pair of legs can be placed inside or proximal the first pair of legs. The second pair of legs is laterally disposed from the first pair of legs. The first pair of legs and the second pair of legs both fold to a vertical position and deploy to a diagonal position. In deployed position, the second pair of legs can lean toward the user, while the first pair of legs can lean away from the user.

The second leg lower section 17 is jointed to the first leg 15 at a first leg upper joint 33. The second leg lower section can be formed as a rectangular metal member. The second leg has a joint above the first leg upper joint 33 at a second leg breaking joint 34. The second leg breaking joint 34 rotates from a straight position to a folded position when the table folds. The second leg breaking joint 34 can be above the first leg upper joint 33.

The second leg upper section 16 can be made in a U-shaped channel and the second leg lower section 17 can be made in a U-shaped channel. If the second leg upper section 16 U-shaped channel has an open side facing upward in the deployed position and the second leg lower section 17 U-shaped channel has an open side facing downward in the deployed position, the second leg upper section 16 U-shaped channel can fold into the open side of the second leg lower section 17 U-shaped channel when the second leg lower section 17 is folded to a folded and stowed position. Folding together can also be called a nesting configuration where the second leg upper section nests inside the second leg lower section. Alternatively, various structural members such as the second leg of the section 16 can be made in a non U-shaped channel configuration also in a standard configuration.

At a lower portion of the table, a lower platform 19 is supported by a lower platform support 20. The lower platform 19 folds upward and can have a lower platform folding joint coaxial to the second leg lower joint 35. The lower platform support 20 is pivotally connected to the lower platform 19 at a lower platform support inside joint 41. The lower platform support 20 can be pivotally connected to the first leg at a lower platform support outside joint 42. The lower platform support 20 can fit inside a slot located on an underside of the lower platform 19. Also, the lower platform support 20 can fit outside a slot located on an underside of the lower platform 19.

Optionally, during folding, the first leg sliding joint can unlatch and shorten its length while folding down from a deployed position to a vertical folded position. The first leg 15 can fold at the first leg upper joint 33. The second leg lower section 17 rotates relative to the first leg 15 at a first leg upper joint 33. The second leg lower section 17 can be coupled to the first leg 15 using a hinge pin inserted across the first leg upper joint 33.

During folding, the second leg breaks at the second leg breaking joint 34. The second leg upper section 16 swivels relative to the plank 11 at the second leg upper joint 31. The second leg upper section 16 rotates relative to the second leg lower section 17 at the second leg breaking joint 34. The second leg lower section 17 rotates relative to the substantially vertical support member 13 at the second leg lower joint 35. The second leg lower joint 35 can incorporate the crossbar member when the second leg is rigidly connected to the crossbar member.

The third leg 21 can be pivotally mounted on the third leg extension 27. The third leg extension 27 extends from the lower end of the substantially vertical support member. The third leg 21 has a third leg first joint member and a third leg second joint member. The third leg 21 is mounted to the substantially vertical support member 13 and swivels downward to provide support against tipping when the table is being folded. The third leg first joint member is pivotally connected to the substantially vertical support member 13 at the third leg swivel joint 36 and is connected to the third leg second joint member at the third leg middle joint member joint 38. The third leg second joint member is pivotally connected to the third leg 21 at the third leg second joint member joint 39. The third leg can lock into a deployed position for supporting the table.

The substantially vertical support member 13 can be pivotally connected to an upper portion of the first leg and pivotally connected to a lower portion of the second leg without being directly connected to the plank, plank frame or the floor. The substantially vertical support member 13 remains vertical even when connected only to the legs. The substantially vertical support member 13 can be a leg. The substantially vertical support member 13 can pivot relative to a bracket mounted to the plank. The first leg pair and the second leg pair can be partially coplanar rather than completely laterally disposed. Optionally, for improved stability, the first leg can have a supplemental support by a swivel connected joint extension to the second leg.

When folded, the first leg 15 folds into the second leg lower section 17. The second leg lower section 17 can be formed as a U-shaped channel with an open side that at least partially receives the first leg 15 at an angle. Thus, the first leg 15 nests inside the second leg lower section 17 in the folded position. The second leg upper section 16 folds over the first leg 15. If the first leg 15 is made as a U-shaped channel, the second leg upper section 16 can fold inside the first leg 15 so as to nest therein or not nest therein.

The first leg optionally has an upper section made of a pair of hinged members. The first leg upper section can be laterally located relative to the first leg lower section. The first leg upper section lower joint can be connected to the first leg and the second leg upper section. The pair of members of the first leg upper section are optionally both nesting U-shaped channels that remain coplanar when folded and deployed.

The first leg 15 can be horizontally offset from the second leg lower section 17 of the second leg upper section 16. As before, the second leg lower section 17 and the second leg upper section 16 can be formed of U-shaped channels so that they nest with each other or not nest with each other.

A third leg extension can provide supplemental support. The third leg extension can be hinged to the third leg 21 at a third leg swivel joint 36. The third leg 21 is hinged to the first leg at a first leg lower joint 61. The first leg lower joint 61 is located distal to the third leg swivel joint 36.

The first leg 15 is connected to the second leg upper section 16 at a intermediate first leg upper joint 67. The intermediate first leg upper joint 67 is a more specific construction of the first leg upper joint 33. The intermediate first leg upper joint 67 is connected to a second leg upper section lower end 62 and may also have a connection to the top surface of the second leg upper section lower end 62.

The second leg upper section lower end 62 preferably includes a second leg locking notch 63 that engages a locking member 64 that protrudes from a side surface of the second leg lower section 17. The locking member 64 can be formed as a knob or pin that protrudes from the locking member slot 66. The locking member 64 translates or slides along the length of the second leg lower section 17. The locking member 64 is biased into an upward position by a locking member spring 65. One or more locking member springs 65 can be installed within a hollow portion of the second leg lower section 17. The locking member springs can be leaf or coil springs. A foot bar 88 or other actuator can be connected to the locking member 64. Stepping on the foot bar 88 draws the locking member 64 out of the second leg locking notch 63 to unlock the table for folding the table.

A second plank 71 can be installed as an optional bookshelf underneath the desk. The second plank 71 is connected to the substantially vertical support member 13 at the second plank main swivel 72. The second plank 71 can fold up to a substantially vertical and stowed position, and can also be folded down to a substantially horizontal deployed position. The second plank outside swivel 73 is connected to the second plank 71 and provides a pivoting swivel connection between the second plank 71 and the second plank support 75. The second plank support 75 is connected to the lower platform 19 at a second plank support lower swivel connection 79. The second plank can have a variety of different constructions similar to the first plank. The second plank support 75 is optional.

Optionally, the second plank has a pair of side rails formed as second plank rail supports 76. The second plank rail supports 76 are formed on a left and right side of the second plank. The second plank rail supports 76 have second plank side rail slots 77 formed as channels on the lower portion of the second plank rail supports 76. The second plank rail supports 76 is preferably pivotally connected to the second plank side rails 74 at the second plank outside swivel 73. The second plank rail supports 76 are pivotally mounted to fold into the channels of the second plank side rail slots 77. The second plank rail supports swivel 78 is preferably formed as a metal member jointed to the first leg 15 at the second plank rail support swivel 78. The second plank rail support swivel 78 is preferably an extension of the first leg upper joint 33 so that they are collinear such as by sharing a common swivel pin that passes through the second plank rail support 76, the first leg 15 and the second leg lower section 17. The second plank rail supports swivel 78 is preferably formed as a metal member jointed to the first leg 15 and/or the second leg lower section 17 at the second plank rail support swivel 78.

The invention claimed is:

1. A folding table comprising:

a. a plank;

b. a substantially vertical support member, wherein the plank is directly or indirectly rotationally connected to the substantially vertical support member, wherein the plank rotates between a substantially horizontal plank deployed position and a substantially vertical plank stowed position;

c. a first leg, wherein the first leg has a first leg upper joint allowing the first leg to fold between a first leg deployed position and a first leg stowed position where the first leg is substantially vertical;

d. a second leg having a second leg first section and a second leg second section, wherein the second leg first section is jointed to the second leg second section, wherein the second leg first section is a second leg upper section, and wherein the second leg second section is a second leg lower section, wherein the second leg upper section is biased by the weight of the plank into a straight collinear position relative to the second leg lower section when the second leg is in a second leg deployed position, when the second leg upper section rotates relative to the second leg lower section, the second leg moves to a second leg stowed position; and e. a second leg upper joint, wherein the second leg upper joint supports the plank, wherein the substantially horizontal plank moves from the stowed position to the deployed position by simultaneously unfolding of the second leg and the first leg from the stowed position to the deployed position wherein the substantially vertical plank moves from the deployed position to the stowed position by simultaneously folding of the first leg and second leg from the deployed position to the stowed position.

2. The folding table of claim 1, further comprising: a third leg pivotally connected to the substantially vertical support member at a third leg swivel joint.

3. The folding table of claim 1, wherein the second leg first section and the second leg second section nest with each other in the second leg stowed position.

4. The folding table of claim 1, further comprising: a lower platform supported by the first leg; and a lower platform support supporting the lower platform, wherein the lower platform support is pivotally connected to the first leg, wherein the lower platform support is pivotally connected to the lower platform.

5. The folding table of claim 1, wherein the plank further includes a plank frame.

6. The folding table of claim 1, wherein the substantially vertical support member is not directly bearing on the floor, because it is supported by a third leg extension or a bottom foot.

7. The folding table of claim 1, wherein the substantially vertical support member is not directly bearing on the plank, because it is connected to the plank frame rather than directly to the plank.

8. The folding table of claim 7, wherein a first leg upper section lower joint further includes a joint extension and a joint extension swivel connecting to the first leg upper section lower member.

9. The folding table of claim 1, further comprising: a third leg pivotally connected to the substantially vertical support member at a third leg swivel joint, wherein the third leg is connected to the substantially vertical support member at a third leg swivel joint, and wherein the third leg is swivel connected to the first leg at a first leg lower joint, wherein the first leg is connected to the second leg upper section at an intermediate first leg upper joint.

10. The folding table of claim 9, wherein the second leg upper section has a locking member fitted to allow a sliding motion within a locking member slot formed on the second leg upper section, wherein the locking member is biased by a locking member spring, wherein the locking member engages a second leg locking notch formed on the second leg upper section lower end.

11. The folding table of claim 9, wherein the second leg lower section has a locking member fitted to allow a sliding motion within a locking member slot formed on the second leg lower section, wherein the locking member is biased by a locking member spring, wherein the locking member engages a second leg locking notch formed on the second leg lower section upper end.

12. The folding table of claim 1, further including a second plank, wherein the second plank is mounted to the substantially vertical support member at a second plank main swivel, wherein the second plank is supported by a second plank support, wherein the second plank is swivel connected to the second plank support at a second plank outside swivel.

13. The folding table of claim 12, further including second plank side rails, wherein the second plank side rails each have a second plank side rail slot, wherein the second plank side rail slot receives a second plank rail support, wherein the second plank rail support is pivotally attached to the second plank side rails at a second plank outside swivel, wherein the second plank real support is also pivotally attached to the second plank rail support swivel and either the first leg upper joint or the second leg lower section.

14. The folding table of claim 1, wherein the first leg has a first leg first section and a first leg second section, wherein the first leg first section slides relative to the first leg second section to telescope in length when the table is folded between a deployed position and a stowed position, wherein the first leg has an adjustable length.

* * * * *